US006050036A

United States Patent [19]

Frey

[11] Patent Number: 6,050,036

[45] Date of Patent: Apr. 18, 2000

[54] FLANGE MOUNTED FRAMING SYSTEM

[75] Inventor: John R. Frey, Riverside, Calif.

[73] Assignee: International Aluminum Corporation, Monterey Park, Calif.

[21] Appl. No.: 09/108,555

[22] Filed: Jul. 1, 1998

[51] Int. Cl.[7] ..... E06B 1/04

[52] U.S. Cl. ..... 52/204.5; 52/211; 52/212; 52/656.2; 52/656.4; 52/656.5; 52/717.01; 52/734.1; 52/745.16; 49/504

[58] Field of Search ..... 52/211, 212, 204.5, 52/656.2, 656.4, 656.5, 656.6, 717.01, 734.1, 745.15, 745.16, 204.55, 204.56, 204.1; 49/504, 505, DIG. 2

[56] References Cited

U.S. PATENT DOCUMENTS

| | | | |
|---|---|---|---|
| 908,858 | 1/1909 | Goddard | 52/212 |
| 2,860,744 | 11/1958 | Mascari | 52/212 |
| 3,545,135 | 12/1970 | Lieber | 49/505 |
| 4,034,513 | 7/1977 | Richardson | 49/504 |
| 4,179,849 | 12/1979 | Kuffner . | |
| 4,280,309 | 7/1981 | Huelsekopf | 52/212 |
| 4,370,828 | 2/1983 | Miro . | |
| 4,407,100 | 10/1983 | Huelsekopf . | |
| 4,642,954 | 2/1987 | Sigerist . | |
| 4,782,630 | 11/1988 | Kleyn | 49/505 |
| 4,912,879 | 4/1990 | Mozuras et al. | 49/505 |
| 5,070,651 | 12/1991 | Jeter | 49/505 |
| 5,203,130 | 4/1993 | Freelove | 52/211 |
| 5,412,909 | 5/1995 | Wu | 49/505 |
| 5,528,869 | 6/1996 | Boomer et al. | 52/212 |
| 5,787,660 | 8/1998 | Adams | 52/212 |

FOREIGN PATENT DOCUMENTS

| | | | |
|---|---|---|---|
| 630220 | 3/1963 | Belgium | 52/212 |
| 0269209 | 6/1988 | European Pat. Off. . | |
| 0240401 | 10/1987 | France . | |
| 1912361 | 7/1970 | Germany | 52/212 |
| 2242431 | 2/1974 | Germany | 52/212 |
| 2260745 | 6/1974 | Germany | 52/212 |
| 1533120 | 11/1978 | Germany . | |
| 2839589 | 3/1980 | Germany | 52/211 |
| 2263495 | 7/1993 | United Kingdom . | |
| 2317410 | 3/1998 | United Kingdom . | |
| 93/19272 | 9/1993 | WIPO . | |

OTHER PUBLICATIONS

"The Boomer Casing", Boomer Industries Limited, 4 page brochure, Dec. 1992.

*Primary Examiner*—Laura A. Callo
*Attorney, Agent, or Firm*—William W. Haefliger

[57] ABSTRACT

In a framing system for attachment to parallel, spaced wall board terminals, the combination comprises a channel member having flanges and a cross-piece extending between the flanges, the flanges spaced apart for embracing the wall board terminals for connection to the terminals, one of the flanges being integral with the cross-piece, and the other of the flanges and the cross-piece having inter-fitting, interlocking elements.

18 Claims, 5 Drawing Sheets

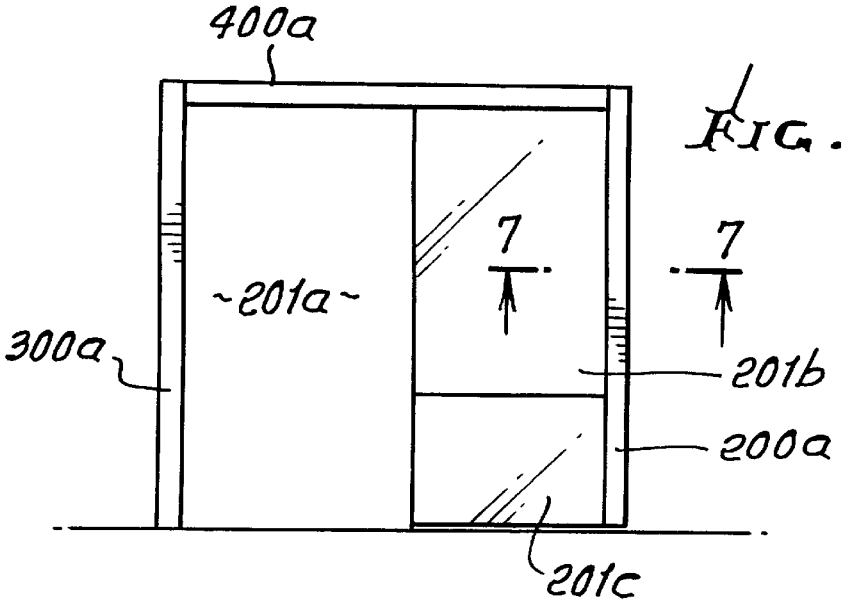
FIG. 6.
FIG. 7.
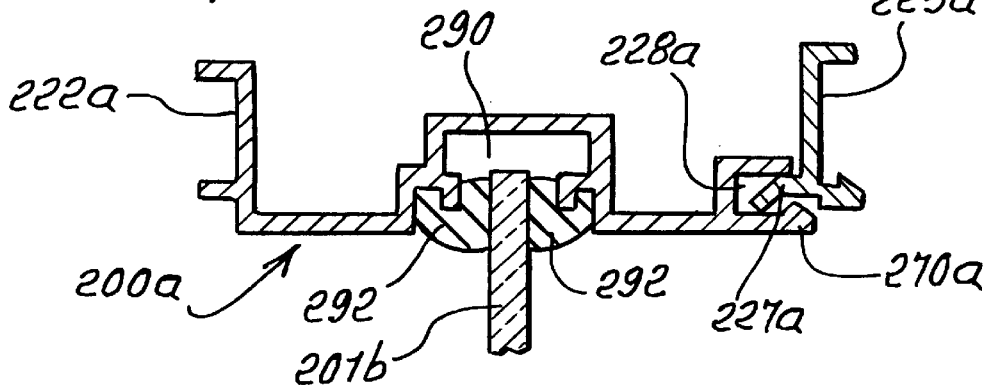
FIG. 8.
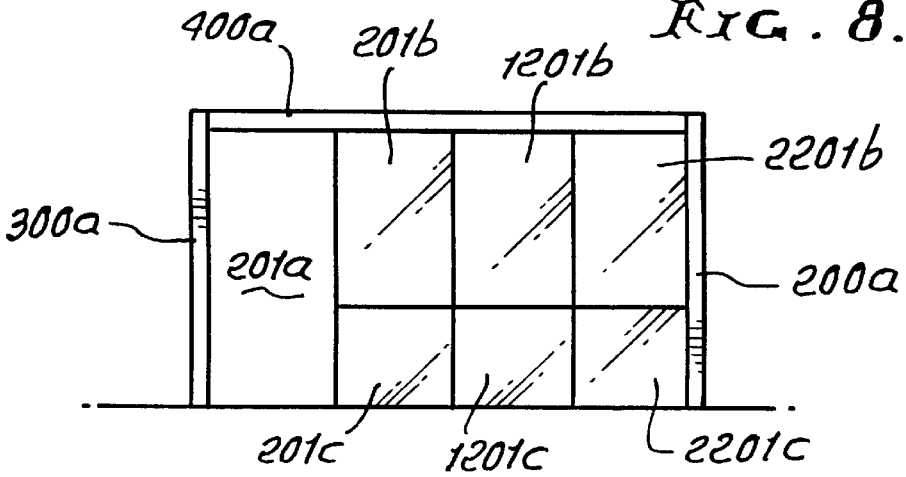

FLANGE MOUNTED FRAMING SYSTEM

BACKGROUND OF THE INVENTION

This invention relates generally to application of framing to wall board terminals, and more particularly to an apparatus and method enabling very rapid framing assembly to and connection to wall board terminals.

There is need for rapid framing methods, in order to reduce the cost of such framing, during construction. No prior methods of which I am aware provide the unique and highly advantageous installation structures, functions and results as are now provided by the present invention.

SUMMARY OF THE INVENTION

It is a major object of the invention to provide improved apparatus and methods meeting the above need. Basically, the framing system of the invention is attached to parallel, spaced wall board terminals, and includes:

a) a channel member having flanges and a cross-piece extending between the flanges, the flanges spaced apart for embracing the wall board terminals for connection to the terminals, b) one of the flanges being integral with the cross-piece, c) the other of the flanges and the cross-piece having inter-fitting, interlocking connection elements.

Such structures facilitate an improved and rapid installation method, which includes the steps:

d) first assembling the one flange and cross-piece into position with the one flange embracing one wall board, e) then connecting the other flange to the cross-piece and to embrace the other wall board, by interfitting and interlocking the connection elements.

Another object of the invention includes provision of interlocking elements comprising tongue and recess components. A projection may be provided in the recess component to block withdrawal of the tongue from the recess. As will be seen, the projection may have a cam surface to be engaged by the tongue as the tongue is inserted into the recess, for temporarily deflecting the projection, providing a quick snap-fit assembly of the flange to the cross-piece.

A further object is to provide stabilizing interfit shoulders on the other flange and cross-piece, holding them in aligned assembled position.

Yet another object is to provide glazing retention structure on the cross-piece, intermediate the two flanges. Also, the improved framing may extend at multiple sizes of the portal, or along multiple edges of the glazing, as will be seen.

These and other objects and advantages of the invention, as well as the details of an illustrative embodiment, will be more fully understood from the following specification and drawings, in which:

DRAWING DESCRIPTION

FIG 1. is an elevation showing framing assembled to wall brace;

FIG 2. is an enlarged section taken on lines 2—2 of FIG. 1;

FIG 3. is a view like FIG. 2, but showing framing being applied to installed wall board;

FIG 4. it is an elevation showing framing extending at the top and sides of a door;

FIG 5. is a section taken through framing as used in FIG. 4;

FIG 6. is an elevation showing framing extending at the top and sides of a doorway and glass panels adjacent the doorway;

FIG 7. is a section taken through framing as used in FIG. 6; and

FIG 8. is an elevation like FIG. 6, but showing multi e side-by-side glass panels.

DETAILED DESCRIPTION

Figure 1:
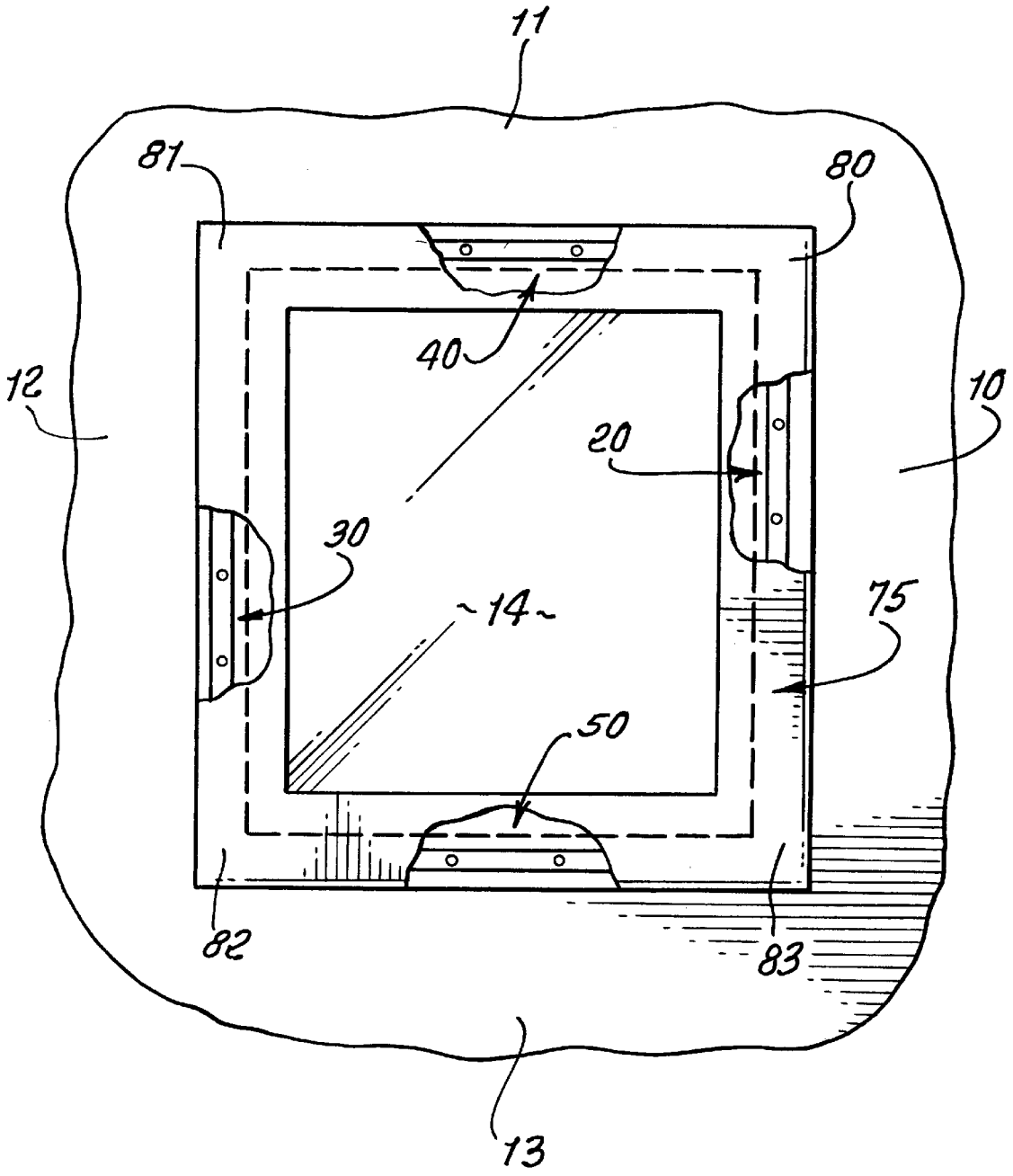
Figure 2:
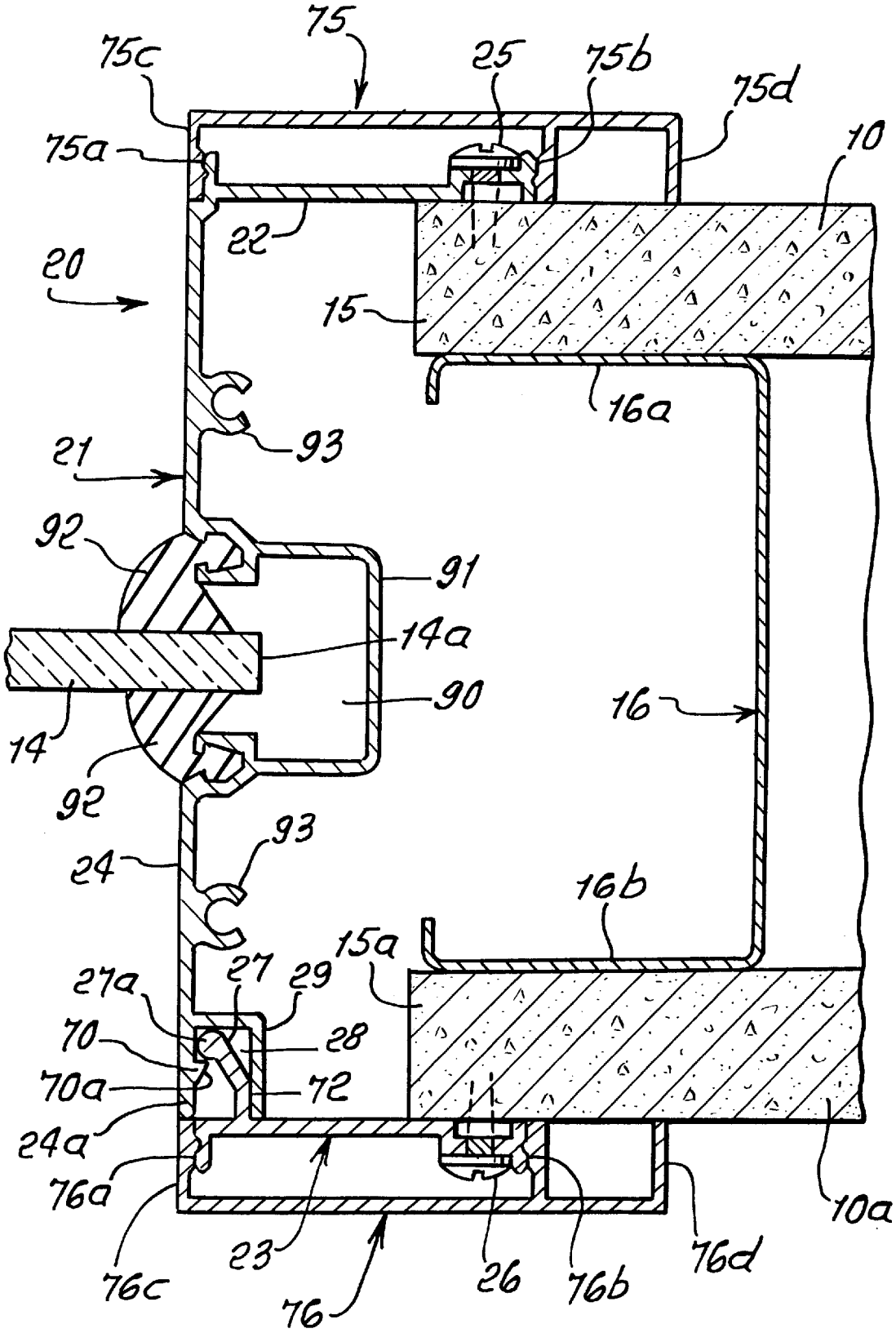

Referring first to FIG. 1, wall boards are shown at 10–13 installed in position about an opening or portal in which glazing 14 is installed. The portal may alternatively be kept open, i.e. free of glazing. The wall boards, typically are installed in parallel relation, as seen in FIG. 2, showing two parallel boards 10 and 10*a* having end terminals 15 and 15*a* extending in spaced apart relation. A thin metallic channel member 16 has flanges 16*a* and 16*b* extending adjacent the inner sides of the wall boards, to position them as shown.

In accordance with the invention, framing 20 is provided for rapid installation at the periphery of the portal, and attached to the wall boards 10 and 10*a*. Like framing may be rapidly installed at one or more of remaining three sides of the portal, as follows:

framing 30 provided at the opposite boundary of the portal for rapid assembly to parallel wall boards 12 and 12*a* (like boards 10 and 10*a*)

framing 40 provided at the upper boundary of the portal, for rapid assembly to parallel wall boards 11 and 11*a* (like boards 10 and 10*a*)

framing 50 provided at the lower boundary of the portal, for rapid assembly to parallel wall boards 13 and 13*a* (like boards 10 and 10*a*). Pairs of the frames may be interconnected at corner locations 80–83.

The framing 20 is shown in FIG. 2 to include a metallic channel member 21 having two laterally extending flanges 22 and 23 and a cross-piece 24 extending longitudinally between the flanges. The flanges extend laterally to project adjacent opposite outer sides of the two wall board terminals and to be connected to them, as by fasteners 25 and 26.

As shown, flange 22 may typically be integral with the cross-piece, i.e. of one piece extruded construction with 24. The other flange 23 and the cross piece are separate but they have interfitting, interlocking components. In the example, these components include a tongue and recess components, as for example the tongue 27 integral with flange 23 and assembled into recess 28 defined by L-shaped structure 29 integral with the cross-piece 24. A projection 70 in the recess and integral with the cross-piece is located to block withdrawal of the turned end 27*a* of the tongue, once the tongue is forcibly assembled into position; such assembly includes forcing the turned end 27*a* of the tongue over the cam surface 70*a* of the projection, to momentarily resiliently deflect the end portion 24*a* of the cross-piece 24. A quick snap-fit assembly is thereby provided. Also, the tongue 27 and structure 29 have interengaged alignment shoulders, at interface location 72. Accordingly, the flange 23 is held rigidly attached to and assembled to the cross-piece, as if it were integral with the cross-piece.

Channel shaped trim caps 75 and 76 are assembled to and over the flanges, as shown. Note clamping interfaces at sub-flange locations 75*a* and 75*b*, and 76*a* and 76*b*. Each trim cap may have the form of a simple rectangular frame, as seen in FIG. 1. The trim caps have snap fit over the flanges 22 and 23. See trim cap sub-flanges 75*c* and 75*d*, and 76*c* and 76*d*.

Figure 3:
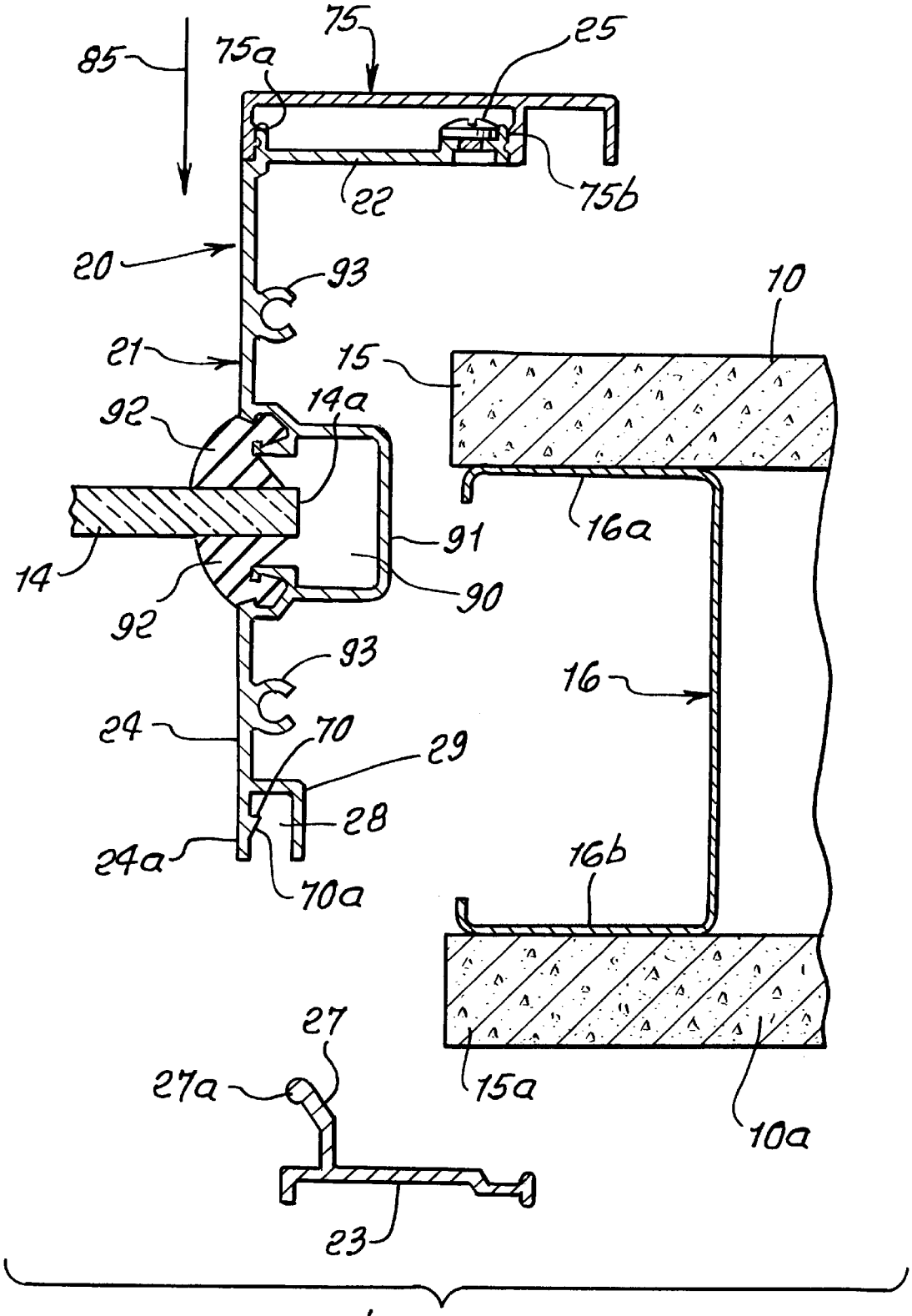

FIG. 3 shows a stage in the assembly of the framing 20 to the wall boards 10 and 10*a*. The flange 22 and cross-piece

24 are being moved in the longitudinal direction indicated by arrow 85, with flange 22 approaching board 10. Flange 22 is fastened to 10, and trim cap 75 applied. Flange 23 is not yet connected to the cross-piece. Trim cap 75 should be understood as not yet applied as shown. After flange 22 engages the outer side of the wall board 10, as seen in FIG. 1, the flange 24 is assembled to the cross-piece, as by insertion of tongue 27 into recess 28 to FIG. 2 position. Flange 24 is fastened to 10*a,* and trim caps 76 applied. This facilitates a rapid and low cost assembly of the framing to the wall boards, as referred to.

Glazing 14 may be carried by the cross-piece, as by locating the glazing periphery 14*a* in the U-shaped recess 90 defined by cross-piece U-shaped structure 91. Note glazing mounts 92. Alignment projections 93 may be provided by the cross-piece to receive alignment rods, during assembly, using multiple framing parts 20 in end-to-end relation. FIGS. 2 and 3 show preferred form of the invention.

Figure 4:
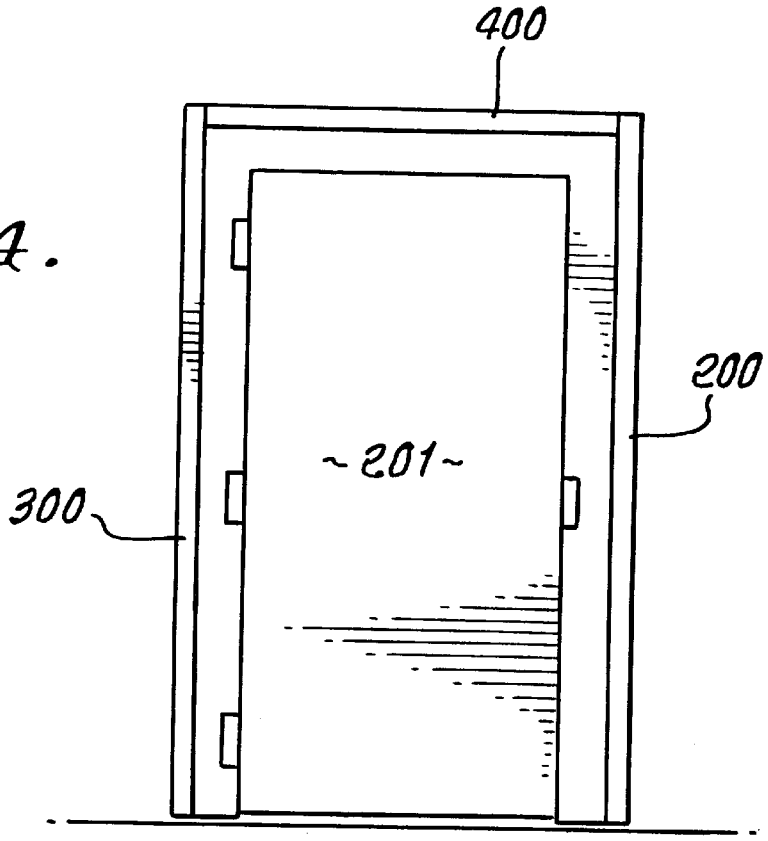
Figure 5:
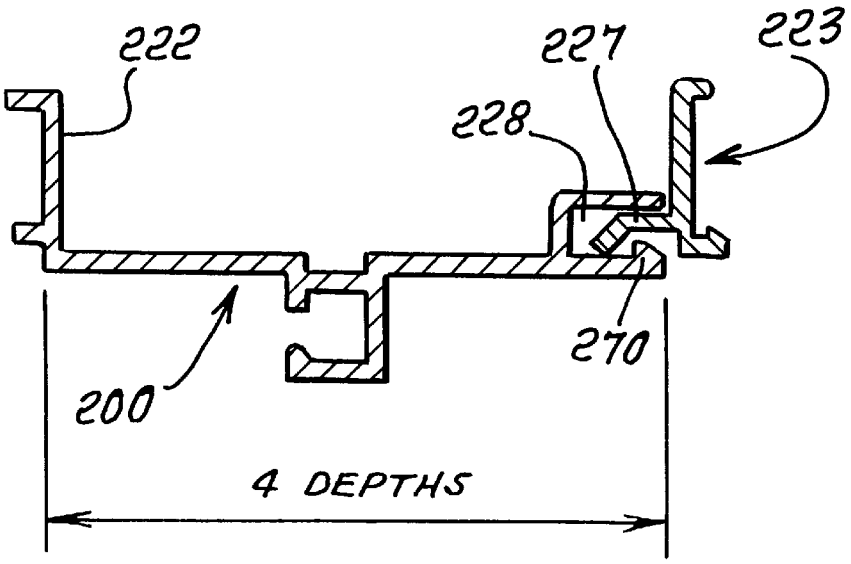

FIG. 4 shows framing 200, 300 and 400 (like framing 20, 30 and 40 of FIG. 1) applied about a door 201. FIG. 5 shows a typical frame cross-section. Elements 200, 222, 223, 227, 228 and 270 correspond to elements 20, 22, 23, 27, 28 and 70 in FIGS. 2 and 3, respectively.

FIG. 6 shows framing 200*a,* 300*a* and 400*a* (like framing 20, 30 and 40 in FIG. 1) applied abut a doorway 201*a* and adjacent glazing panels 201*b* and 201*c*. FIG. 7 shows a typical frame cross-section. Elements 200*a,* 222*a,* 223*a,* 227*a,* 228*a* and 270*a* correspond to elements 20, 22, 23, 27, 28 and 70 in FIGS. 2 and 3, respectively. Glazing 201*b* is retained by mounts 292, such as elastomeric material, the glazing edge 201*bb* protectively concealed in a recess 290.

FIG. 8 is like FIG. 6, but adds two more side-by-side glass panels 1201*b* and 1201*c,* and 2201*b* and 2201*c,* as shown.

Advantages of the framing system include the following:

1) Flange mounted framing system allows for factory prefinished framing to be completely shop fabricated and installed at the job site into finished drywall rough openings.
   a) May be shipped to job site and then preassembled at the job site, before installing into finished drywall rough openings.
   b) May be shipped to job site as preassembled panels ready for installation into finished drywall rough openings using snap-together vertical mullions.
   c) May be shipped to job site as glazed preassembled panels ready for installation into finished drywall openings using snap-together vertical mullions.
2) The flange framing system also allows for doorframes, doorframes with sidelights to also be installed as preassembled units.
   a) The doors may be installed into the assembled frame prior to installation.
   b) The glass may also be installed into the preassembled sidelight prior to installation.
   c) The door frame and sidelight may be preassembled as a composite unit and installed into prefinished rough openings.
3) The sidelight and borrowed light openings provide for flush glazing on all four sides with no projecting glass stops or exposed fasteners. Top load elastomeric extruded glazing gaskets are used on both sides of the glazing infill to secure the infill into the glazing pockets and to eliminate any visible raw glass edges.

I claim:

1. In a framing system for attachment to parallel, spaced wall board terminals, the system combination comprising a) a channel member having flanges and a cross-piece extending between said flanges, said flanges spaced apart for embracing the wall board terminals for connection to said terminals, b) one of said flanges being integral with the cross-piece, c) the other of said flanges and the cross-piece having inter-fitting, interlocking elements, including tongue and recess components, d) and a trim cap overlying said other flange and having a flange that interlocks with said channel member other flange with snap-fit in close proximity to said interlocking elements including said tongue and recess components, said trim cap flange extending into adjacent relation to said cross-piece, whereby a self stabilized, three component, locally interlocked assembly is defined by said channel member cross-piece and other flange, and said trim cap flange.

2. The combination of claim 1 including said wall board terminals to which said member flanges are connected.

3. The combination of claim 1 including glazing retention structure on said cross-piece.

4. The combination of claim 1 wherein said framing system extends at least part way about a portal.

5. The combination of claim 4 wherein said framing system includes framing sections extending at least part-way about said portal, each section including one of said channel members.

6. The combination of claim 5 including glazing retention structures on said sections, and portal glazing retained by said glazing retention structures.

7. The combination of claim 1 including a projection in said recess component to block withdrawal of the tongue from the recess.

8. The combination of claim 7 wherein the projection has a cam surface to be engaged by the tongue as the tongue is inserted into the recess, for temporarily deflecting the projection, providing a quick snap-fit assembly of the channel member other flange to the cross-piece.

9. The combination of claim 7 including stabilizing inter-fit shoulders on the other flange and cross-piece, and on the cross-piece and the trim cap flange holding them in aligned assembled position.

10. The combination of claim 1 wherein said trim cap is connected in position to overlie said member other flange and also to have interlocking relation to the other flange in spaced relation to said assembly, thereby to define a multi-component second locally interfitting assembly.

11. The combination of claim 1 including another trip cap connected in position to overlie said one member flange and to have locally interlocked relation therewith.

12. The combination of claim 1 wherein multiple of said channel members are installed to define an opening, the channel members being interconnected.

13. The combination of claim 12 including trim caps overlying flanges of the channel members, and having locally interlocked relation therewith.

14. The combination of claim 1 wherein said framing system bounds one of the following:

a) a window b) a door c) a doorway and adjacent glass panel structures d) a doorway and adjacent multiple glass panels.

15. The method of providing a framing system for attachment to parallel, spaced wall board terminals, the combination comprising a) a channel member having flanges and a cross-piece extending between said flanges, said flanges spaced apart for embracing the wall board terminals for connection to said terminals, b) one of said flanges being integral with the cross-piece, c) the other of said flanges and the cross-piece having inter-fitting, interlocking elements, said method including:

d) first assembling the one flange and cross-piece into position with the one flange embracing one wall board, e) then connecting the other flange to the cross-piece and to embrace the other wall board, by interfitting and interlocking said elements, f) there being a trim cap having a flange, and including attaching said trim cap flange to said member other flange in close proximity to said interlocking elements to provide a three-component locally interlocked assembly, said trim cap flange extending into adjacent relation to said cross-piece.

16. The method of claim 15 including employing fasteners to attach the member flanges to the respective wall boards.

17. The method of claim 15 wherein multiple of said channel members are provided to define an overall assembly defining an opening, and said overall assembly is attached to said one wall board via said one flange of each channel member prior to said connecting of the other flange of each channel member to the other wall board.

18. In a framing system for attachment to parallel, spaced wall board terminals, the combination comprising a) a channel member having flanges and a cross-piece extending between said flanges, said flanges spaced apart for embracing the wall board terminals for connection to said terminals, b) one of said flanges being integral with the cross-piece, c) the other of said flanges and the cross-piece having inter-fitting, interlocking elements, d) a first trim cap overlying said other flange and having a flange that interlocks with said channel member other flange in proximity to said interlocking elements including said tongue and recess components, said trim cap flange extending into adjacent relation to said cross-piece, whereby a self stabilized, three component, locally interlocked assembly is defined by said channel member cross-piece and other flange, and said trim cap flange, e) a second locally interlocked assembly defined by a second flange of said first trim cap assembly interlocked to said member other flange in spaced relation to said first assembly, f) and a second trim cap and a third locally interlocked assembly defined by a flange of said second trim cap interlocked to said member one flange.

* * * * *